US005374913A

United States Patent [19]

Pissantezky et al.

[11] Patent Number: 5,374,913

[45] Date of Patent: Dec. 20, 1994

[54] TWIN-BORE FLUX PIPE DIPOLE MAGNET

[75] Inventors: Sergio Pissantezky, The Woodlands; Peter M. McIntyre, College Station, both of Tex.

[73] Assignee: Houston Advanced Research Center, The Woodlands, Tex.

[21] Appl. No.: 807,369

[22] Filed: Dec. 13, 1991

[51] Int. Cl.[5] ..... H01F 1/00; H01J 29/76; H01J 23/00; H05H 7/00

[52] U.S. Cl. ..... 335/216; 335/210; 315/501; 315/503

[58] Field of Search ..... 335/216, 210; 505/879; 328/230, 232, 233, 234, 235, 236, 238, 253, 254

[56] References Cited

U.S. PATENT DOCUMENTS

| | | | |
|---|---|---|---|
| Re. 30,466 | 12/1980 | Ikegami | 335/213 |
| 3,916,239 | 9/1975 | Friedlander | 313/460 |
| 3,919,677 | 11/1975 | Young et al. | 335/216 |
| 4,019,989 | 4/1977 | Hazewindus | 25-/396 ML |
| 4,115,191 | 9/1978 | Ott | 176/3 |
| 4,577,156 | 3/1986 | Kerst | 328/237 |
| 4,745,367 | 5/1988 | Dustmann | 328/235 |
| 4,851,799 | 7/1989 | Hilal | 335/216 |
| 4,916,404 | 4/1990 | Tsumaki | 328/233 |
| 4,988,950 | 11/1991 | Nakayama | 328/235 |
| 4,996,496 | 2/1991 | Kitamura | 328/228 |
| 5,148,137 | 9/1992 | Purcell | 335/301 |
| 5,175,466 | 12/1992 | Seward | 313/231.31 |

OTHER PUBLICATIONS

Colvin, et al., "The High Field Superferric Magnet", *Nuclear Instruments and Methods in Physics Research*, A270 (1988) pp. 207–211.

Otter, "Concepts for the Design of Magnets at Target Locations Subjected to Very High Radiation Levels", *I.E.E.E. Transactions on Magnetics*, (1988) Mar., vol. 24, No. 2, pp. 047–050.

Hirabayshi, "Dipole Magnet Development in Japan", *I.E.E.E. Transactions on Magnets*, vol. MAG-19, No. 3, May 3, 1983, pp. 198–203.

Perin, "State of the Art in High-Field Superconducting Magnets for Particle Accelerators", *Particle Accelerators*, vol. 28 (Gordon and Breach, 1990), pp. 147–160.

Huson, et al., "The High Field Superferric Magnet II", *Particle Accelerators*, vol. 28 (Gordon and Breach, 1990), pp. 213–218.

Colvin, et al., "The High Field Superferric Magnet", *Nuclear Instruments and Methods in Physics Research* A270 (Elsevier Science Publishers B.V., 1988) pp. 207–211.

Brianti, "The Large Hadron Collider (LHC) in the LEP Tunnel", *Particle Accelerators*, vol. 26 (Gordon and Breach, 1990), pp. 141–150.

Krevet, et al., "Superconducting Magnets for Compact Synchrotrons," (*IEEE Trans. Magnets* (Mar. 1988) pp. 827–830.

*Primary Examiner*—Leo P. Picard
*Assistant Examiner*—Stephen T. Ryan
*Attorney, Agent, or Firm*—Vinson & Elkins

[57] ABSTRACT

A superconducting magnet for use in a particle accelerator of the synchotron type is disclosed. The disclosed magnet includes twin bores, each having beam pipes therein. A flux pipe is provided between the twin bores such that a 360° magnetic flux path is formed. A superconducting coil encircles the bores and flux pipe, for generating the transverse magnetic field across the beam pipes. The flux pipe may be formed of non-magnetic material for a linear magnet, or alternatively may be formed of ferromagnetic laminations parallel to the direction of the magnetic field to form a superferric magnet with minimal eddy current generation. The flux pipe includes magnetic stress relief bubbles near the bores, compensating for the crowding effect near the inner radius of the flux pipe. Bands are provided around the magnet, including filler material therewithin, which are formed of a material having a high coefficient of thermal expansion; upon cooldown of the magnet, the contraction of the bands applies a inward prestress force upon the coil, counteracting the inverse Lorentz forces generated by the magnetic field.

23 Claims, 3 Drawing Sheets

TWIN-BORE FLUX PIPE DIPOLE MAGNET

This invention is in the field of superconducting magnets, and is more particularly directed to such magnets as useful in particle accelerators.

BACKGROUND OF THE INVENTION

As is well known in the field of modern physics, the study of atomic structure and forces requires the use of extremely short wavelength energy to achieve the resolution necessary to observe subatomic particles. Particle accelerators of various types, such as cyclotrons, synchocyclotrons, and synchotrons, have been used to accelerate hadrons (e.g., protons) into high energy beams which, when collided with a target material, effect the identification and measurement of subatomic particles. In order to detect increasingly smaller particles, the energy to which the hadrons are accelerated must increase because, due to the quantum theory, the wavelength of accelerated particles is inversely proportional to their energy. It is expected that the acceleration of particles to energies of on the order of trillions of electron volts (TeV) will be required to further the state of the art in the study of atomic structure and forces.

Particle accelerators of the synchotron type accelerate particles by way of RF (radio frequency) electrostatic fields through which the beam of particles periodically pass while traveling around a path of substantially constant radius. As is well known, the accelerated particles are maintained within the constant radius path by a transverse magnetic field controlled to increase in magnitude along with the energy to which the particles are accelerated. Some conventional particle accelerators circulate two particle beams, closely parallel to one another but traveling in opposite directions, around the accelerator path. The transverse magnetic field in such accelerators is provided by two separate superconducting magnets, each associated with one of the beam paths.

As the ultimate energy of the acceleration increases, either the radius of the path or the magnitude of the magnetic field (or both) must increase accordingly. Due to the geographical constraints and accompanying construction costs of large radius accelerators, it is desirable to provide extremely high magnetic field magnets for accelerators of the synchotron type, with the fields of up to on the order of several Tesla expected for new accelerators. A discussion of the accelerator cost versus magnetic field strength appears in Perin, "State of the Art in High-Field Superconducting Magnets for Particle Accelerators", *Particle Accelerators,* Vol. 28 (Gordon and Breach, 1990), pp.147–160.

A conventional design for large field superconducting magnets in particle accelerators is the so-called "cosine-$\theta$" winding design. According to this design, the superconducting coils surround the magnet bore (within which the beam path will travel) with turns having a density proportional to the cosine of the angle from the horizontal. A high strength non-magnetic laminate collar surrounds the superconducting coil in these designs, with a heavy ferromagnetic shield surrounding both the collar and the coils to provide to reduce field leakage. The Perin article cited hereinabove describes, among others, conventional cosine-$\theta$ magnets.

The high magnetic fields in such magnets not only maintain the particle beam on the desired path, but also exert inverse Lorentz forces on the magnet structure, particularly the superconducting coils. If a prestressed coil element moves during operation, the energy released can induce local quenching of the superconductivity of the coil element, resulting in localized Joule heating and causing loss of the superconducting state throughout the coil, as described in Huson, et al., "The High Field Superferric Magnet II", *Particle Accelerators,* Vol. 28 (Gordon and Breach, 1990), pp. 213–218. After a quench event, de-energizing and re-cooling of the coil is therefore necessary in order to regain the superconducting state.

In conventional cosine-$\theta$ designs, the coils are therefore prestressed by the collar with a pattern of loading forces designed to compensate for the inverse Lorentz forces produced in operation. Such prestress loading has been relatively successful in cosine-$\theta$ magnets for medium field strengths. However, magnetic fields of on the order of 6.5 to 9.0 Tesla are believed to exceed the limit of the strength of conventional collar materials arranged in the cosine-$\theta$ design, especially considering that the inverse Lorentz force increases with the square of the magnetic field. It is therefore believed that the practical limit of the cosine-$\theta$ design will be exceeded for new accelerators of reasonable geographic size.

By way of further background, a superferric accelerator magnet design is described in Colvin, et al., "The High Field Superferric Magnet" *Nuclear Instruments and Methods in Physics Research* A270 (Elsevier Science Publishers B.V., 1988), pp. 207–211, and in the Huson, et al. cited hereinabove. This superferric magnet is a single bore magnet including a combination of window-frame and cosine-$\theta$ coils, thus providing a magnet with two modes of operation. Shielding and mechanical prestress is provided by a superferric iron shield and metallic plungers surrounding the bore. While this magnet is contemplated to be useful in high field accelerator applications, its size and weight for a single bore magnet is perceived to be undesirable and costly.

By way of further background, a twin-bore magnet is described in Brianti, "The Large Hadron Collider (LHC) in the LEP Tunnel", *Particle Accelerators,* Vol. 26 (Gordon and Breach, 1990), pp. 141–150, and in the Perin article cited hereinabove. This magnet includes twin cosine-$\theta$ magnets surrounded by a single heavy iron shield. It is apparent that the weight and size of this magnet will be quite substantial considering the shielding required, and it is also contemplated that the prestressing of the two cosine-$\theta$ coils will be relatively complicated.

It is therefore an object of this invention to provide a twin-bore high field magnet which provides a highly uniform magnetic field, particularly where the transverse field through a beam pipe in each bore is substantially independent of radial distance.

It is a further object of this invention to provide such a magnet which includes a flux pipe for return flux so that additional shielding requirements are reduced, if not eliminated.

It is a further object of this invention to provide such a magnet which provides excellent prestressing of the coils and thus reduces the likelihood of localized quenching.

It is a further object of this invention to provide such a magnet that is relatively small and compact.

Other objects and advantages of the present invention will be apparent to those of ordinary skill in the art having reference to the following description together with the drawings.

SUMMARY OF THE INVENTION

The invention may be incorporated into a twin bore tubular magnet for a particle accelerator, where the bores are rectangular apertures in a flux pipe, within which are contained the beam pipe through which accelerated particles travel. Superconducting coils encircle the flux pipe and the apertures, and generate a transverse magnetic field relative to the axis of the bores for guiding a beam of accelerated charged particles in an accelerator of the synchotron type in the conventional manner. On either side of the bore, the flux pipe is shaped so as to have an outer magnetic stress relief bubble prior to narrowing into a funnel adjacent the bore. The bubble relieves the magnetic field prior to the funnel, allowing for a highly uniform flux to be returned to the bores. The flux pipe is preferably formed of laminated iron sheets, encircled by banding which provides additional prestress loading on the structure upon cooldown, by way of differential thermal contraction.

DETAILED DESCRIPTION OF THE PREFERRED EMBODIMENT

Figure 1:
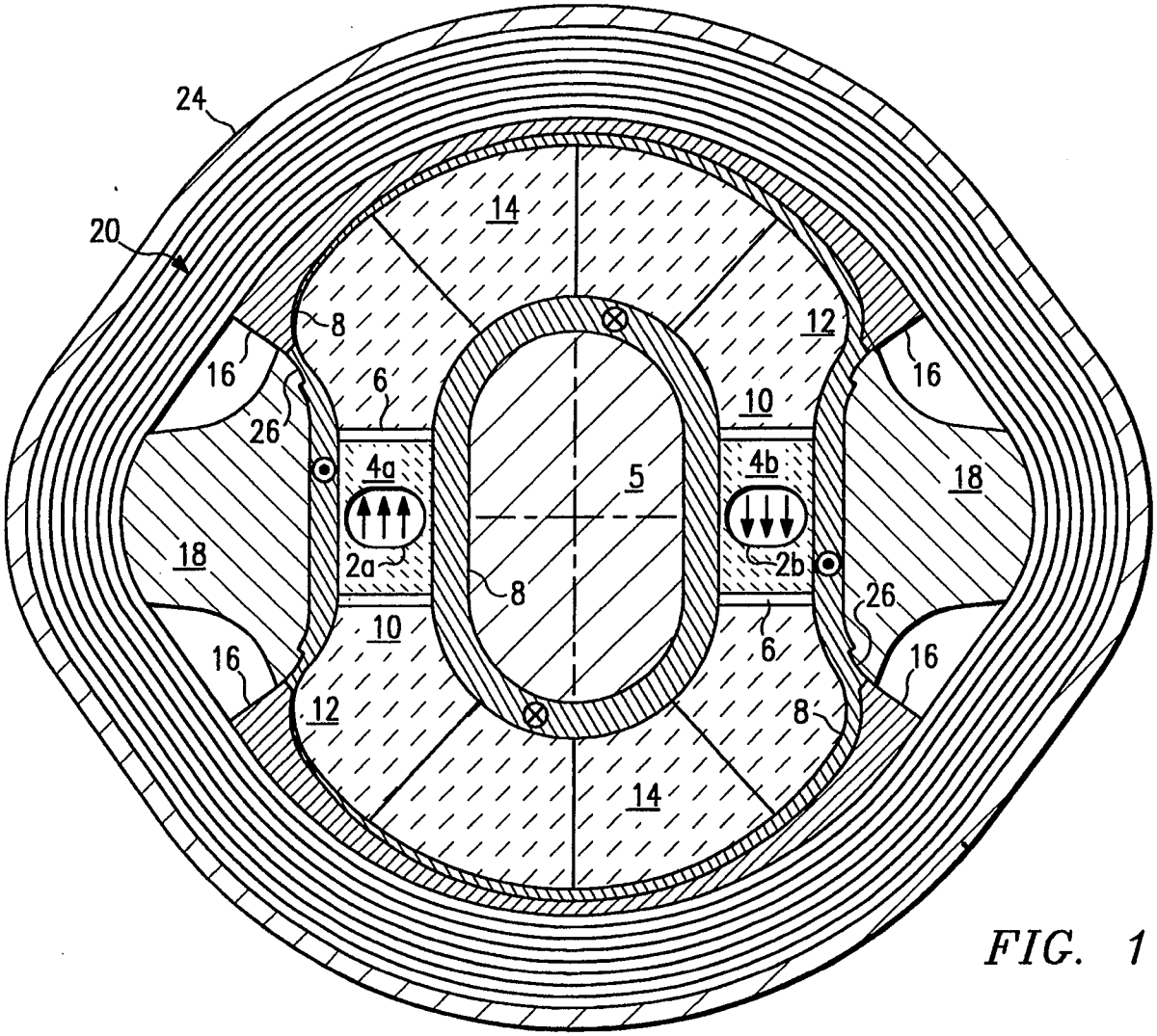
FIG. 1 is a cross-sectional diagram of a magnet according to the preferred embodiment of the invention.

Referring first to FIG. 1, a twin bore magnet according to the preferred embodiment of the invention is illustrated in cross-section. This magnet is intended for use in particle accelerators of the synchotron type, and as such the cross-section of FIG. 1 is taken within a section of the magnet. As is well known in the art, the guiding magnets for synchotron accelerators are configured as a series of individual magnets; between certain ones of the individual magnets are RF accelerating stations which accelerate the particles in similar manner as is done in RF linear accelerators.

In this example of the magnet, twin beam pipes *2a, 2b* are located within bores *4a, 4b* disposed on opposite sides of center structure 5. Center structure 5 is preferably formed of a solid structure of high strength material such as steel or INCONEL alloy. Beam pipes *2a, 2b* are oval openings within rectangular bores *4a, 4b*, through which the accelerated particles will travel in operation, guided by the transverse magnetic field generated by this embodiment of the magnet. The magnetic field is generated by superconducting coil 8 which surround bores *4a, 4b* and the remainder of the flux path in the magnet of FIG. 1; the construction of coil 8 will be described in further detail hereinbelow.

In this example, the magnetic fields are vertical through beam pipes *2a, 2b*, as suggested by the arrows therethrough in FIG. 1, with a downward orientation (north-to-south) in beam pipe *2b* and an upward orientation in beam pipe *2a*. The direction of current flow through coil 8 is indicated by the dot (current out of the page of FIG. 1) for the paths of coil 8 outside of bores *4a, 4b* and cross (current into the page) for the paths of coil 8 inside of bores *4a, 4b*, thus generating the magnetic field in the directions indicated in beam pipes *2a, 2b*.

Accordingly, two beams of positively charged particles such as protons can travel through beam pipes *2a, 2b* in opposite directions, with the transverse magnetic field in beam pipes *2a, 2b* guiding the beams along a path of constant radius. In this example, a proton beam in beam pipe *2b* would be traveling in a clockwise direction (looking down on the portion of the magnet shown in FIG. 1), while the proton beam in beam pipe *2a* would be traveling in a counterclockwise direction. In this example, beam pipes *2a, 2b* are approximately 4 cm in width and 3 cm in height when viewed in the cross-section of FIG. 1. The axial length of beam pipes *2a, 2b* around the circumference of the accelerator is contemplated to be on the order of 100 km, for the example of a 40 TeV accelerator using a guiding magnetic field of on the order of 13 Tesla.

Bores *4a, 4b* are constructed as substantially rectangular structures of non-magnetic material such as INCONEL alloy having beam pipes *2a, 2b* therewithin. Adjacent each top and bottom surface of bores *4a, 4b* are pole face correctors 6 formed as horizontal superconducting coils, in the conventional manner; pole face correctors 6 finely tune the magnetic field entering bores *4a, 4b* so as to be highly uniform, with no undesired variation as a function of radius. In some cases, variation of the magnetic field with radial distance from the center of beam pipes *2a, 2b* may be desired to assist in focusing the particle beam; it is contemplated that pole face correctors 6 may be used to effect the tuning of the field in bores *4a, 4b* and the associated beam pipes *2a, 2b*.

The structure of bores *4a, 4b* is preferably precisely controlled, to provide highly uniform field therethrough. The sides of bores *4a, 4b*, and thus the tangential component of the field, are defined by flat precision wound coil 8 thereabout. In addition, pole face correctors 6 are preferably adjusted in such a manner as to cause the tangential field components at the top and bottom areas to vanish. The field within each of bores *4a, 4b* is thus determined by the boundary conditions at its interface with flux pipe 14 (via pole face correctors 6, if present), and is thus contemplated to be very homogenous.

Flux pipe 14 is disposed between bores *4a, 4b* on each side (i.e., top and bottom) of the magnet according to this embodiment of the invention. Flux pipe 14 serves as a path for magnetic flux within the magnet according to this embodiment of the invention. As such, flux pipe 14 may be constructed of nonmagnetic solid material, or may be an air-filled path through which the magnetic flux can pass. Where non-magnetic (gaseous, liquid or solid) material fills flux pipe 14, the resulting magnet will be linear, so as to have a full dynamic range from minimum to maximum field values (corresponding to the minimum and maximum particle energies), while maintaining the same level of field quality within bores *4a, 4b*.

Figure 2:
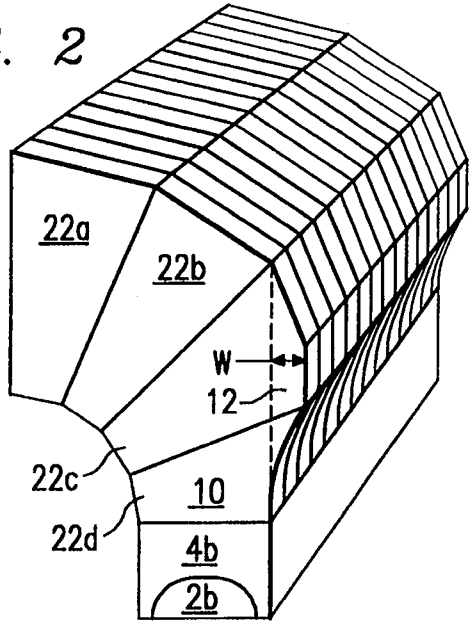
FIG. 2 is a perspective view of a portion of the magnet of FIG. 1, illustrating the construction of the flux pipe.

Referring now to FIG. 2, the construction of flux pipe 14 according to the preferred embodiment of the invention will be described in further detail. Flux pipe 14 according to the preferred embodiment of the invention is constructed of iron laminations, having their planes parallel with the magnetic flux (and parallel to the plane of the cross-section of FIG. 1). A quarter section of flux pipe 14 is illustrated in perspective view in FIG. 2, showing a typical individual magnet according to the present invention as incorporated into a particle accelerator of the synchotron type. The length of the magnet will depend on the accelerator design, as the particular construction of this embodiment of the invention may be used for a magnet of any length. The use of ferromagnetic material in flux pipe 14 makes this magnet superferric, as the magnetic field is enhanced by the ferromagnetic flux return path of flux pipe 14. As a result, less superconductor is required than in the case where flux pipe 14 is formed of non-magnetic material.

As shown in FIG. 2, flux pipe 14 is constructed as multiple laminations 22, preferably formed of a ferromagnetic material such as iron. The planes of each of laminations 22 are parallel with the direction of magnetic flux (and thus parallel to the cross-section of the magnet as shown in FIG. 1). Construction of flux pipe 14 of laminations 22 is preferred in this embodiment of the invention, as this allows each lamination 22 to be precisely stamped, and thus much more inexpensively produced relative to other manufacturing methods, such as machining flux pipe 14 from a solid block of iron. In addition, the construction of flux pipe 14 from laminations 22 also reduces the generation of eddy currents by the high magnetic fields, as described in U.S. Pat. No. 4,783,628 issued Nov. 8, 1988, and in U.S. Pat. No. 4,822,772 issued Apr. 18, 1989, both incorporated herein by this reference. In this example, each of iron laminations 22 are preferably on the order of 0.15 cm thick.

The shapes of iron laminations 22 are selected not only to mate with one another when installed, but also to guide the magnetic flux within the magnet in the desired manner, according to two functions. A first function of bending the flux around the corner between bores 4a, 4b is performed by those of laminations 22 in flux pipe 14 near the top and bottom of the magnet; in the quarter magnet structure shown in FIG. 2, lamination sets 22a, 22b serve this flux bending function.

The second function of flux pipe 22 is to present the return flux to bores 4a, 4b in a uniform manner, particularly sufficiently uniform as to be finely adjustable by pole face correctors 6 to the desired field pattern in beam pipes 2a, 2b. According to the present invention, the field uniformity presented to bores 4a, 4b is accomplished by shaping certain ones of laminations 22 so as to have an outer magnetic stress relief bubble 12, and a funnel region 10. Bubble 12 allows the flux to "expand" prior to reaching funnel region 10 and bore 4b, thus reducing the peak field at the inner edge of flux pipe 14 and counteracting the natural crowding effect of the magnetic flux near the inner radius of a curve. The width W of bubble 12 is contemplated to be on the order of 2.5 cm in this example; it is contemplated that the particular shape and dimensions of bubble 12 for specific magnets may be readily determined by one of ordinary skill in the art having reference to this description, by way of computer modeling.

Figure 4:
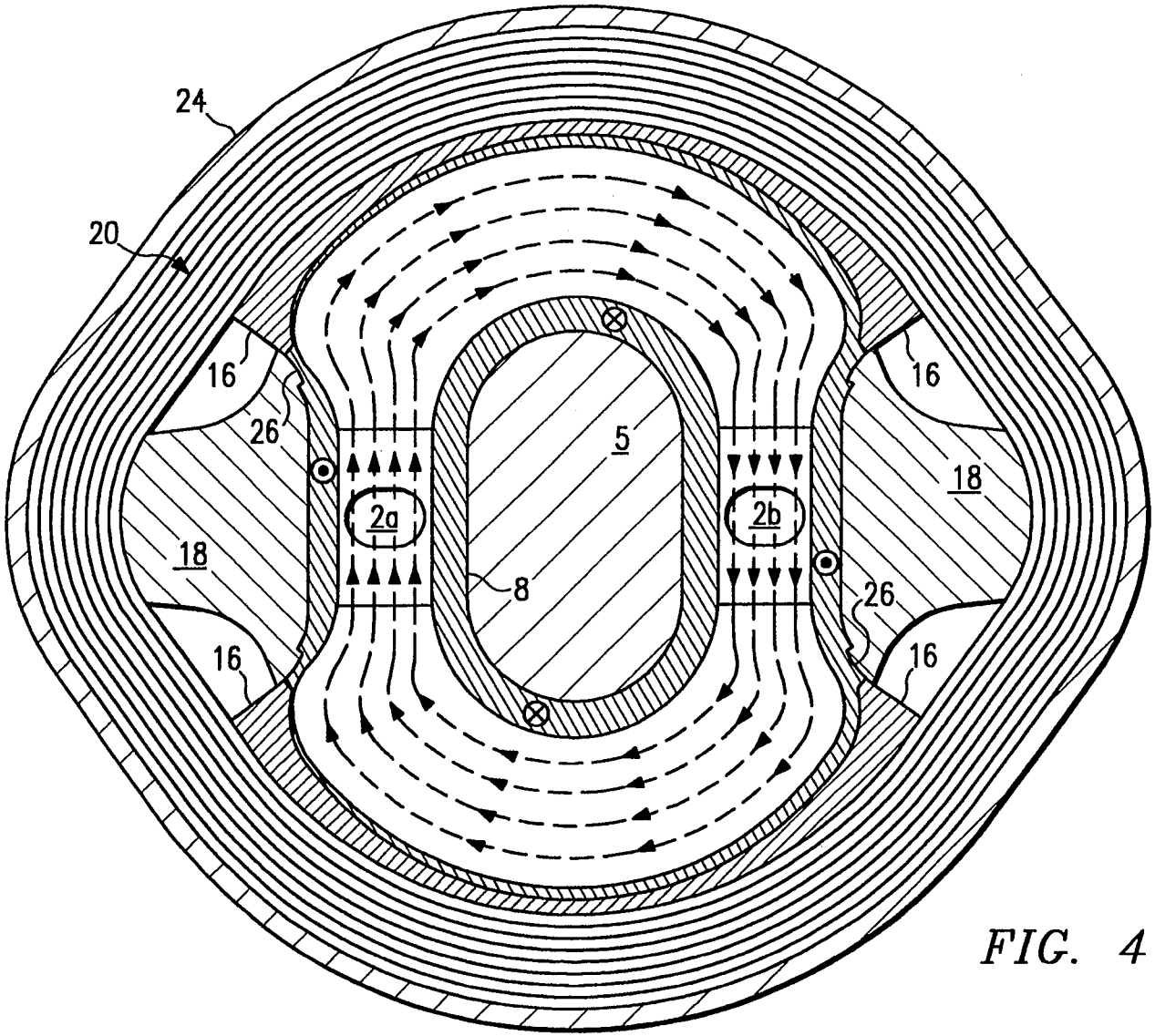
FIG. 4 is a cross-section of the magnet of FIG. 1, illustrating the magnetic flux lines therethrough while in operation.

Funnel region 10 compresses the flux prior to its injection into bore 4b (in FIG. 2), in a manner which is substantially symmetrical relative to a vertical midplane through beam region 2b, due to the effect of bubble 12. FIG. 4 illustrates the flux lines through the magnet of FIG. 1, where the field strength is indicated in the conventional manner by the density of flux lines per linear distance. As illustrated therein, the field is non-uniform in the curved portion of the flux path at the top and bottom of the magnet, but the provision of bubble 12 at the outer edge of flux pipe 14 near bores 4a, 4b allows for compensation of the crowing effects, thus allowing a relatively uniform field to be presented to beam pipes 2a, 2b.

It is contemplated that the width of flux pipe 14 around its outer perimeter need not be constant, and indeed is preferably not constant for purposes of cost and weight. The size of bores 4a, 4b and the required field strength therein define the amount of magnetic flux to be contained by flux pipe 14. Since the maximum field strength at the curved portions of flux pipe 14 (e.g., laminations 22a, 22b) is at the inner radius, flux pipe 14 may be made just wide enough so that this maximum field equals the peak value of the field in bores 4a, 4b. Design of this width can be determined, for a particular magnet configuration, by way of computer modeling and other techniques available to one of ordinary skill in the art. This allows the current requirements for the superconductor to be uniform about flux pipe 14 and bores 4a, 4b, such that coil 8 can consist of a single wire, in the manner described hereinbelow.

Figure 3:
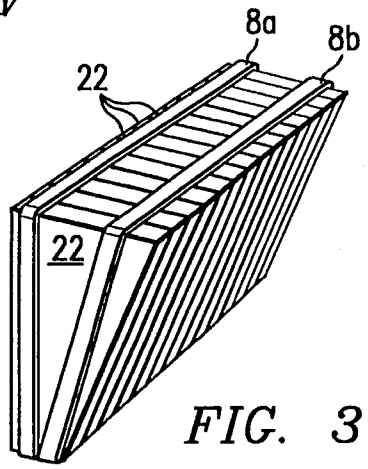
FIG. 3 is a perspective view of one of the sections of the flux pipe illustrating the implementation of superconducting coils thereabout.

As noted hereinabove and as shown in FIG. 1, the magnetic field is generated by superconducting coil 8 which encircles flux pipe 14 and bores 4a, 4b. Referring now to FIG. 3, the construction of superconducting coil 8 will be discussed in detail. FIG. 3 illustrates a portion of flux pipe 14, namely a set of parallel laminations 22, about which are shown two turns 8a, 8b of superconducting wire (exaggerated in size for purposes of clarity) used in coil 8; of course, more turns will be provided in an actual magnet to provide sufficient current density for the desired magnetic field, but are not shown for purposes of clarity. For example, the linear current density for a 13 Tesla magnet according to the present invention will require a current density of on the order of 104,000 amperes per cm. The desired density of wire will, of course, be less around the outer edge than at the inner edge, resulting in coil 8 being thinner around the outside of the path than the inside as illustrated in FIG. 1.

The preferred construction of coil 8, for a high field (13 Tesla) magnet includes rectangular copper-stabilized $Nb_3Sn$ multi-strand superconducting cable, having a width of on the order of 6 mm and a thickness of on the order of 1.0 to 1.5 mm, with each turn insulated by fiberglass cloth. Coil 8 is fabricated section-by-section (FIG. 3 illustrating a single section), with the sections connected together in series once in place in the magnet. It is also preferable that coil 8 be wound prior to reacting the $Nb_3Sn$ alloy, to avoid the possibility of damage after reaction.

As noted hereinabove, it is contemplated that the peak field in bores 4a, 4b be substantially equal to the maximum field at the inner edge of flux pipe 14. This allows the entirety of coil 8 to be a single coil, as the conduction requirements of the superconductor will be uniform along the entire length of the flux path. As noted hereinabove, the individual coil sections can be connected together in series once installed.

Referring back to FIG. 1, filler material 16 and plungers 18 are disposed outside of coil 8. Plungers 18 are preferably formed of relatively strong non-magnetic material, such as 316L stainless steel, to provide structural integrity and support for bores 4*a*, 4*b*; filler 16 need not provide such support, but is preferably non-magnetic material such as an austenitic stainless steel (e.g., 316L stainless steel). In addition, it is also contemplated that filler 16 may not be necessary if plungers 18 are able to sufficiently transfer prestress loading to coil 8.

Surrounding fillers 16, 18 are prestress bands 20, which encircle the magnet for preventing motion of the conductors in coil 8 in operation as a result of inverse Lorentz forces. Each of bands 20 are preferably formed of 316L stainless steel and have a thickness of on the order of 0.127 cm; in this example, eight such bands 20 encircle the magnet assembly. The material of band 20 preferably has a larger coefficient of thermal expansion than that of filler 16 and plungers 18, so that bands 20 may be easily installed about thereabout at room temperature, but so that, after cooldown of the magnet to its superconducting temperature, the greater degree of contraction of bands 20 serve to apply an inward-directed stress toward magnet 20. The differential contraction upon cooldown thus provides a prestress loading upon the outer portions of coils 8, preventing their movement during operation. The transmission of the compressive prestress transmitted to coils 8 is facilitated via teeth 26 in the assembly of coils 8 near bubbles 12 of flux pipe 14, and adjacent filler 16 and plungers 18. Solid center structure 5 also limits coil 8 movement during operation, by its support of the inner structure of the magnet.

As illustrated in FIG. 1, plungers 18 in this example are preferably shaped so as to be wider at the locations thereof contacting coil 8 than at the locations thereof contacting bands 20. This shape of plungers 18 was selected by way of conventional stress modeling, so that the prestress transferred from bands 20 to coils 8 by plungers 18 matches, as closely as possible, the inverse Lorentz forces at each location of coils 8.

Filler 16 will generally not be required to transfer as much prestress as plungers 18, as it is expected that the fields (and thus the inverse Lorentz forces) at the portions of coil 8 near the top and bottom of the magnet will be substantially less than that near bores 4*a*, 4*b*. Indeed, the prestress applied by bands 20 to the top and bottom portions of the magnet (i.e. to the tops and bottom of flux pipe 14) may inherently be greater than that necessary to counter the inverse Lorentz forces; as such, it may be preferable to reduce the prestress applied at these locations by directly contacting coil 8 with bands 20 at the top and bottom.

Figure 5:
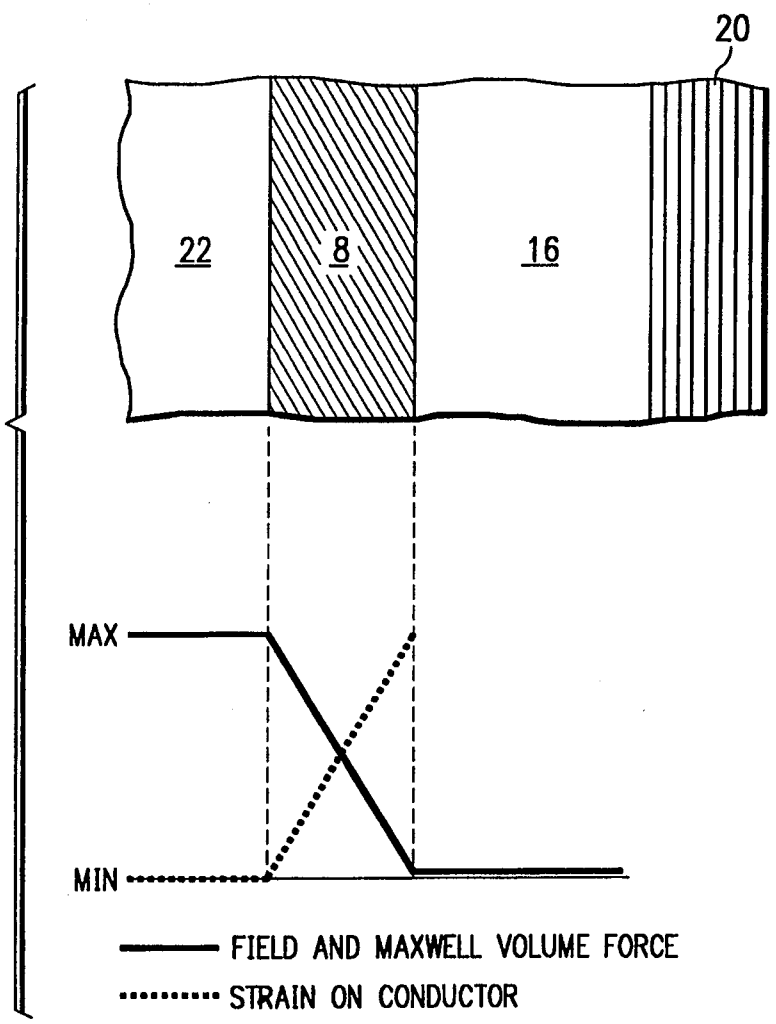
FIG. 5 is a partial cross-section of a portion of the magnet of FIG. 1, with a corresponding field and stress diagram.

It is further contemplated that the construction of the magnet according to the preferred embodiment of the invention, with prestress bands 20 exerting an inward force on coil 8, provides for improved superconductor utilization. Referring now to FIG. 5, a portion of the magnet described hereinabove is illustrated in cross-section, together with a normalized plot of the magnetic field and the conductor stress and strain, corresponding thereto. As illustrated in FIG. 5, the magnetic field is at a maximum within coil 8 at its inner edge closest to iron laminations 22 and at a minimum at the outer edge of coil 8 adjacent filler 16 (in the location illustrated in FIG. 5). The stress and strain applied to the conductors within coil 8 is at a maximum at the outer edge of coil 8 adjacent filler 16, however, and at a minimum at the inner edge of coil 8 adjacent iron laminations 22.

It is well known in the art that the current carrying capacity of superconducting material degrades with increasing magnetic field, and with increasing strain (particularly for $Nb_3Sn$). In conventional superconducting magnets, the amount of superconductor material utilized in the coil depends upon the current carrying capacity of the weakest portion of the coil (as the same magnitude is carried by each incremental portion of the coil). For example, conventional cosine-$\theta$ magnets have high field levels at the same locations of the coil at which high strain levels are present, resulting in some locations of the coil having highly degraded current carrying capacity relative to other locations. Since the amount of superconductor must be selected in order to carry the desired current at all locations of the coil, the amount of superconductor for much of the length of the coil is excessive in such conventional superconducting magnets.

In contrast, coil 8 in the magnet according to the preferred embodiment of the invention has substantially uniform current carrying capacity throughout, independent of radius. This is because, for an increasing radial distance in coil 8, the increasing degradation in current carrying capacity of the conductors in coil 8 due to the increased strain is compensated for by the reduced degradation in current carrying capacity of coil 8 resulting from the reducing magnetic field; conversely, the high degradation due to magnetic field at the inner edge of coil 8 is compensated for by the low degradation due to the low strain thereat. The location of highest strain in coil 8 is thus at the location of lowest field, and the location of highest field in coil 8 is at the lowest strain location.

It is therefore contemplated that the current carrying capacity of conductors in coil 8 of the magnet according to the preferred embodiment of the present invention will be approximately one-half of the stress-free state (or zero field state) throughout the thickness of coil 8. This uniformity in current carrying capacity as a function of radius of coil 8 allows for the proper amount of superconducting material to be used along the entire length of coil 8, with no excess superconductor at some locations as a result of designing for the weakest portion, as in conventional magnets. As the cost of the superconductor material is a significant factor in the overall cost of the magnet, it is contemplated that a magnet may be constructed according to the present invention at less cost than according to conventional designs.

Surrounding bands 20 is shell 24, which corresponds to the outer surface of the cryostat. The interior of shell 24 is cooled to superconducting temperatures by way of a conventional cryogenic system (not shown). The cryogenics are relatively efficient according to the present invention, as the cross-section of this example of a 13 Tesla magnet is contemplated to be on the order of 57 cm in height and 53 cm in width, thus providing a high field magnet suitable for use in conventional synchotron tunnels.

As a result of the present invention, therefore, it is contemplated that a high magnetic field dipole magnet may be constructed which presents a highly uniform field to two bores, and thus particle beams traveling in opposing directions. The use of a flux pipe contains the magnetic flux such that additional shielding is not necessary. The construction of the magnet also ensures that inverse Lorentz forces do not move the coil conductors and cause quenching of the superconductivity.

It is further contemplated that various applications of the present invention may be made other than providing a guiding field in a twin bore particle accelerators of the synchotron type. For example, a single bore magnet may be constructed by forming flux pipe 14 with its bending section covering 270°. It is contemplated that similar construction may be used in the design of synchotron light sources and bending magnets, as well as for use in other conventional applications for dipole magnets applied to orbiting particle beams.

While the invention has been described herein relative to its preferred embodiment, it is of course contemplated that modifications of, and alternatives to, this embodiment, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A superconducting magnet, comprising:

a coil of superconducting wire;

a first bore structure disposed within said coil, having first and second ends, and having a beam pipe opening therethrough; and a flux pipe disposed substantially within said coil adjacent said first bore structure on its two ends, and having a curved shape to form a magnetic circuit within said coil between said first and second ends of said first bore structure.

2. The magnet of claim 1, further comprising:

filler material surrounding said coil; and a prestress band assembly surrounding said filler material, said prestress band assembly having a coefficient of thermal expansion greater than that of said filler material.

3. The magnet of claim 2, wherein said filler material comprises a plunger, formed of non-magnetic material, disposed between said prestress band assembly and said coil.

4. The magnet of claim 2, wherein said prestress band assembly comprises a plurality of prestress bands.

5. A superconducting magnet, comprising:

a coil of superconducting wire;

a first bore disposed within said coil, having first and second ends, and having a beam pipe opening therethrough;

a second bore disposed within said coil, said second bore having first and second ends, and having a beam pipe opening therethrough; and a flux pipe disposed within said coil adjacent said first bore on its two ends, and having a curved shape to form a magnetic circuit within said coil between said first and second ends of said first bore, comprising:

a first flux pipe portion disposed within said coil between the second end of said first bore and the first end of said second bore; and a second flux pipe portion disposed within said coil between the second end of said second bore and the first end of said first bore.

6. The magnet of claim 5, further comprising:

a plurality of pole face correctors, each disposed adjacent one of the first and second ends of said first and second bores.

7. A superconducting magnet comprising:

a coil of superconducting wire, having a toroidal shape;

a first bore disposed within said coil, having first and second ends, and having a beam pipe opening therethrough; and a flux pipe disposed within said coil adjacent said first bore on its two ends, having a curved shape to form a magnetic circuit within said coil between said first and second ends of said first bore, and comprising:

a curved portion;

a first bubble portion adjacent said curved portion, having an outer radius greater than the outer radius of the coil adjacent said first bore;

a first funnel portion disposed between the first bubble portion and the first end of said first bore, having an outer radius which narrows from that of said first bubble portion to that of said first bore;

a second bubble portion adjacent said curved portion, having an outer radius greater than the outer radius of the coil adjacent said first bore; and a second funnel portion disposed between the second bubble portion and the second end of said first bore, having an outer radius which narrows from that of said second bubble portion to that of said first bore.

8. The magnet of claim 7, wherein said flux pipe is comprised of non-magnetic material.

9. The magnet of claim 8, wherein the non-magnetic material is air.

10. The magnet of claim 7, wherein said flux pipe comprises a ferromagnetic material.

11. The magnet of claim 10, wherein said flux pipe comprises:

a plurality of laminations, each having its major planar surface in a direction parallel to the magnetic field produced by said coil.

12. A superconducting magnet, comprising:

a coil of superconducting wire;

a first bore disposed within said coil, having first and second ends, and having a beam pipe opening therethrough;

a second bore disposed within said coil, said second bore having first and second ends, and having a beam pipe opening therethrough; and a flux pipe disposed within said coil adjacent said first bore on its two ends, having a curved shape to form a magnetic circuit within said coil between said first and second ends of said first bore, and comprising:

a first flux pipe portion disposed within said coil between the second end of said first bore and the first end of said second bore, comprising:

a first curved portion;

a first bubble portion adjacent said first curved portion, having an outer radius greater than the outer radius of the coil adjacent said first bore;

a first funnel portion disposed between the first bubble portion and the second end of said first bore, having an outer radius which narrows from that of said first bubble portion to that of the second end of said first bore;

a second bubble portion adjacent said first curved portion, having an outer radius greater than the outer radius of the coil adjacent the first end of said second bore; and a second funnel portion disposed between the second bubble portion and the first end of said second bore, having an outer radius which narrows from that of said second bubble portion to that of said second bore; and a second flux pipe portion disposed within said coil between the second end of said second bore and the first end of said first bore, comprising:

a second curved portion;

a third bubble portion adjacent said second curved portion, having an outer radius greater than the outer radius of the coil adjacent said second bore;

a third funnel portion disposed between the third bubble portion and the second end of said second bore, having an outer radius which narrows from that of said third bubble portion to that of said second bore;

a fourth bubble portion adjacent said second curved portion, having an outer radius greater than the outer radius of the coil adjacent said first bore; and a fourth funnel portion disposed between the fourth bubble portion and the first end of said first bore, having an outer radius which narrows from that of said fourth bubble portion to that of said first bore.

13. The magnet of claim 12, further comprising:

a plurality of pole face correctors, each disposed adjacent one of the first and second ends of said first and second bores.

14. The magnet of claim 12, wherein the magnetic field along the inner radius of said first and second curved portions is approximately equal to the peak magnetic field in the first and second bores.

15. A twin bore dipole superconducting magnet for a particle accelerator, comprising:

first and second bore assemblies, each having first and second ends and having a beam pipe opening therethrough;

a first flux pipe portion disposed between the second end of said first bore and the first end of said second bore;

a second flux pipe portion disposed substantially within said coil between the second end of said second bore and the first end of said first bore; and a toroidal coil of superconducting wire wrapped around said first and second bore assemblies and said first and second flux pipe portions, for generating a magnetic field transverse to the beam pipe openings in said first and second bore assemblies.

16. A twin bore dipole superconducting magnet for a particle accelerator, comprising:

first and second bore assemblies, each having first and second ends and having a beam pipe opening therethrough;

a first flux pipe portion disposed between the second end of said first bore and the first end of said second bore, and comprising:

a first curved portion having first and second ends;

a first bubble portion disposed between the first end of said first curved portion and the second end of said first bore, and having an outer radius greater than that of the second end of said first bore;

a first funnel portion disposed between the first bubble portion and the second end of said first bore, having an outer radius which narrows from that of said first bubble portion to that of said second end of said first bore;

a second bubble portion disposed between the second end of said first curved portion and the first end of said second bore, and having an outer radius greater than that of the first end of said second bore; and a second funnel portion disposed between the second bubble portion and the first end of said second bore, having an outer radius which narrows from that of said second bubble portion to that of said first end of said second bore;

a second flux pipe portion disposed within said coil between the second end of said second bore and the first end of said first bore, and comprising:

a second curved portion having first and second ends;

a third bubble portion disposed between the first end of said second curved portion and the second end of said second bore, and having an outer radius greater than that of the second end of said second bore;

a third funnel portion disposed between the third bubble portion and the second end of said second bore, having an outer radius which narrows from that of said third bubble portion to that of said second end of said second bore;

a fourth bubble portion disposed between the second end of said second curved portion and the first end of said first bore, and having an outer radius greater than that of the first end of said first bore; and a fourth funnel portion disposed between the fourth bubble portion and the first end of said first bore, having an outer radius which narrows from that of said fourth bubble portion to that of said first end of said first bore; and a coil of superconducting wire wrapped around said first and second bore assemblies and said first and second flux pipe portions, for generating a magnetic field transverse to the beam pipe openings in said first and second bore assemblies.

17. The magnet of claim 16, further comprising:

a plurality of pole face correctors, each disposed adjacent one of the first and second ends of said first and second bores.

18. The magnet of claim 16, wherein said first and second flux pipe portions each comprise a non-magnetic material.

19. The magnet of claim 16, wherein said first and second flux pipe portions each comprise ferromagnetic material.

20. The magnet of claim 19, wherein said first and second flux pipe portions each comprise a plurality of ferromagnetic laminations, each having planar surfaces parallel to the direction of the magnetic field.

21. The magnet of claim 16, further comprising:

filler material surrounding said coil; and a prestress band assembly surrounding said filler material, said prestress band assembly having a coefficient of thermal expansion greater than that of said filler material.

22. The magnet of claim 21, wherein said filler material comprises:

a plunger, formed of non-magnetic material, in contact with said prestress band assembly and with said coil.

23. The magnet of claim 16, wherein the magnetic field along the inner radius of the first and second curved portions is approximately equal to the peak magnetic field in the first and second bores.

* * * * *